US008146472B2

(12) United States Patent
Nishimura et al.

(10) Patent No.: US 8,146,472 B2
(45) Date of Patent: Apr. 3, 2012

(54) PAPER CUTTING DEVICE HAVING RECEIVING PART

(75) Inventors: Kazuo Nishimura, Ishikawa (JP); Toshiyuki Majima, Ishikawa (JP)

(73) Assignee: Daido Kogyo Co., Ltd., Ishikawa (JP)

( * ) Notice: Subject to any disclaimer, the term of this patent is extended or adjusted under 35 U.S.C. 154(b) by 777 days.

(21) Appl. No.: 11/884,365

(22) PCT Filed: Mar. 6, 2006

(86) PCT No.: PCT/JP2006/304268

§ 371 (c)(1),
(2), (4) Date: Aug. 15, 2007

(87) PCT Pub. No.: WO2006/103877

PCT Pub. Date: Oct. 5, 2006

(65) Prior Publication Data

US 2010/0175527 A1 Jul. 15, 2010

(30) Foreign Application Priority Data

Mar. 25, 2005 (JP) ..... 2005-087450

(51) Int. Cl.
*B26D 7/02* (2006.01)
*B26D 5/08* (2006.01)
*B26D 7/20* (2006.01)

(52) U.S. Cl. ..... 83/642; 83/638; 83/465; 83/658

(58) Field of Classification Search ..... 83/638, 83/658, 659, 640–641, 69, 72
See application file for complete search history.

(56) References Cited

U.S. PATENT DOCUMENTS

| | | | | |
|---|---|---|---|---|
| 1,236,508 | A * | 8/1917 | Wadhams | 83/57 |
| 3,837,250 | A * | 9/1974 | Lumn | 83/424 |
| 3,975,976 | A * | 8/1976 | Prentice | 83/556 |
| 4,133,712 | A * | 1/1979 | Geschwender | 156/512 |
| 5,042,340 | A * | 8/1991 | Kasper | 83/73 |
| 6,068,416 | A * | 5/2000 | Kumamoto et al. | 400/491 |
| 6,321,964 | B1 * | 11/2001 | Yamaguchi et al. | 225/96 |
| 6,717,800 | B2 * | 4/2004 | Takeda | 348/748 |
| 6,853,549 | B2 * | 2/2005 | Xu | 361/679.39 |
| 7,033,190 | B1 * | 4/2006 | Chen | 439/159 |
| 7,469,622 | B2 * | 12/2008 | Nishimura et al. | 83/638 |
| 2003/0210497 | A1 * | 11/2003 | Aoishi et al. | 360/133 |

FOREIGN PATENT DOCUMENTS

| | | |
|---|---|---|
| JP | 2001-88084 | 4/2001 |
| JP | 2003-136471 | 5/2003 |
| JP | 2003-191196 | 7/2003 |

* cited by examiner

*Primary Examiner* — Ghassem Alie
*Assistant Examiner* — Bharat C Patel
(74) *Attorney, Agent, or Firm* — Wenderoth, Lind & Ponack, L.L.P.

(57) ABSTRACT

A paper cutting device, for cutting multiple sheets of paper stacked in layers on a table, comprises a paper retainer (2) descending from an upper side along a guide and a cutter (3) diagonally ascending from the lower side. A receiving part (18) is mounted on the lower surface of a paper retaining frame (20). The receiving part (18) is formed by joining a base plate (36) with a large elastic modulus such as a metal to a resin receiving plate (37). A slip prevention structure is installed on the junction surfaces of the base plate (36) and the receiving plate (37) to suppress the extension/retraction of the receiving part of the paper retainer so as to prevent wrinkles from occurring in the paper near a blade receiving surface when the paper is cut off.

14 Claims, 10 Drawing Sheets

PAPER CUTTING DEVICE HAVING RECEIVING PART

TECHNICAL FIELD

The present invention relates to a cutting device for cutting multiple sheets of paper or the like stacked in layers, and more particularly, to a cutting device for cutting paper or the like provided with a blade receiving part on a paper retaining frame.

BACKGROUND ART

In cutting devices for cutting paper or the like, there is "push cutting", in which a cutter is pushed in a direction perpendicular to the edge of the blade when cutting, and "pull cutting", in which the cutter is pushed while moving parallel to the edge of the blade when cutting. For example, in JP-A-2001-88084 and the like, a method is employed that emphasizes the latter "pull cutting", in which the edge of the cutter blade bites slightly into a blade receiving surface of a receiving part, and at the same time, in order to improve sharpness, the paper is cut while moving parallel to the blade receiving surface.

When cutting paper using the "pull cutting" described above, material is used for a blade receiving surface 41 such that an edge 44 of a cutter 43 bites into the blade receiving surface 41 of a receiving part 40 as shown in FIG. 5. This is because if a hard blade receiving surface 41 into which the blade edge 44 could not bite were used, the blade edge 44 of the cutter 43 would very quickly become unable to cut. Therefore, a slight groove 42 is formed in the blade receiving surface 41 by the blade edge 44 of the cutter 43.

Typically, taking into consideration "undulation" of the blade edge 44, unevenness of the blade receiving surface 41 and so forth, the bite is set to a depth of approximately 0.3 mm to 0.7 mm. Moreover, in order to allow the blade edge to bite, metal or the like having a large elastic modulus cannot be used for the material used for the blade receiving surface of the receiving part, and typically a resin such as polypropylene (PP) is used.

However, when the cutter is moved parallel to the blade receiving surface with the blade edge biting in, the blade receiving surface of the receiving part deforms in the direction of movement of the cutter by the friction exerted thereon.

FIGS. 6A and 6B illustrate the deformation of the receiving part 40 when the cutter 43 moves parallel to the blade receiving surface with the blade edge biting into the blade receiving surface 41 of the receiving part 40. At this point, although the receiving part 40 is fixed in place at both ends, when the cutter 43 moves in the direction of the arrow with the blade edge 44 biting in, one region A extends and deforms while an opposite region B contracts and deforms, the two regions divided along a center. If the material of the resin receiving part 40 is polypropylene (PP), its elastic modulus is approximately 1/100 that of steel, or from $10^3$ to $10^4$ kg/cm$^2$. As a result, if the length of the receiving part 40 is 300 mm, then at the center a positional displacement of 0.4 mm to 0.8 mm appears.

Consequently, the deformation described above causes wrinkles to appear in 1-2 sheets of paper in the vicinity of the receiving part 40. If, for example, the cutting device is built into a copy machine, then when cutting the paper immediately after copying, if wrinkles appear in the paper, the copy surface might be disrupted, causing text or figures to be blurred, other paper surfaces to be sullied, and so forth.

SUMMARY OF THE INVENTION

Accordingly, an object of the present invention is to provide a paper cutting device that prevents wrinkles from arising in paper in pull cutting as described above and is capable of cutting without a blade receiving surface of a paper retainer receiving part deforming due to a parallel movement of the blade edge of the cutter.

The paper cutting device according to the present invention mounts a cutter below a paper retainer, with the paper retainer, which retains the paper from above, having a receiving part that receives a cutter blade, and cuts the paper with the ascending cutter. Moreover, so as to make positional displacement of multiple sheets of paper stacked in layers difficult, the paper cutting device cuts the paper by raising the cutter vertically diagonal, such that the paper is cut one sheet at a time from the bottom and waste paper falls away naturally. Therefore, the waste paper does not remain in the vicinity of the receiving part and attach to the blade edge.

In the paper cutting device of the present invention, the cutter that cuts the multiple sheets of paper stacked in layers is moved diagonally in a long direction of the cutter, cutting the multiple sheets of paper while moving along slanted guide grooves. The paper retainer is comprised of a paper retaining frame and a receiving part mounted on the paper retaining frame, and is capable of moving along a pair of vertically extending guides. When cutting the last paper, the blade edge of the cutter bites into the blade receiving surface of the receiving part, and the cutter is moved parallel to the blade receiving surface with the blade edge biting in. However, the paper cutting device has a capability that does not allow the blade receiving surface to deform.

Specifically, the paper cutting device of the present invention is a paper cutting device for cutting multiple sheets of paper stacked in layers on a table, comprising a pair of vertically extending guides; a paper retainer that moves vertically along the guides to retain paper from above; and a cutter that moves vertically diagonally, ascends from below diagonally, and cuts the paper, the paper retainer comprising a receiving part that contacts an uppermost paper and receives a cutter blade and a paper retaining frame that carries the receiving part mounted on a bottom surface thereof and engages the guides, the receiving part formed by joining a base plate having a large elastic modulus such as a metal to a resin receiving plate, with slip prevention means being installed at a junction surface of the base plate and the receiving plate to prevent mutual slippage of the base plate and the receiving plate.

As the slip prevention means, a displacement stop convexity may be provided on one of the junction surfaces of the base plate and the receiving plate and a displacement stop concavity may be provided on another of the junction surfaces, the displacement stop convexity engaging the displacement stop concavity.

Moreover, as the slip prevention means, innumerable fine spike-like projections may be formed on the junction surface of the base plate and the spike-like projections may be made to bite into the junction surface of the resin receiving plate.

Preferably, the paper cutting device having receiving part according to the present invention further comprises a motor to drive the paper retainer; a screw that is rotated by the motor; a nut that engages the screw; a link that couples the nut to the paper retainer; a pair of guides, each having a guide groove that extends in a diagonal direction, the pair of guides holding between them the cutter blade so that the cutter blade slides freely within the guide grooves; a slider that extends in a perpendicular direction with respect to a surface of the cutter and engages the guide grooves; and a mechanism that moves the receiving part a certain pitch when a cutter stroke count reaches a predetermined number.

In the paper cutting device of the present invention, the cutter that cuts the multiple sheets of paper stacked in layers is moved diagonally in a long direction of the cutter, cutting the multiple sheets of paper while moving along slanted guide grooves. A receiving part is mounted on the paper retainer, and when cutting the last paper the blade edge of the cutter bites into the blade receiving surface of the receiving part and in this state moves in the long direction. Both ends of the receiving part are fixedly mounted in place, and moreover at its remaining portions the receiving part is combined with a base plate having a large elastic modulus so as to suppress extension deformation of the receiving part.

In the paper cutting device having receiving part of the present invention, both ends of the receiving part of the paper retainer are fixedly mounted in place and attached to the paper retainer main unit, and moreover, the receiving part is given a composite structure, in which the base plate having a large elastic modulus such as a metal and a resin receiving plate are joined together, with slip prevention means provided at the junction surface thereof. As a result, extension deformation of the receiving part due to cutting friction can be prevented. Therefore, extension/contraction deformation of the receiving part is prevented even with movement in the long direction with the blade edge biting into the blade receiving surface, and thus wrinkles no longer appear in the paper in the vicinity of the blade receiving surface.

DETAILED DESCRIPTION OF THE INVENTION

Figure 1:
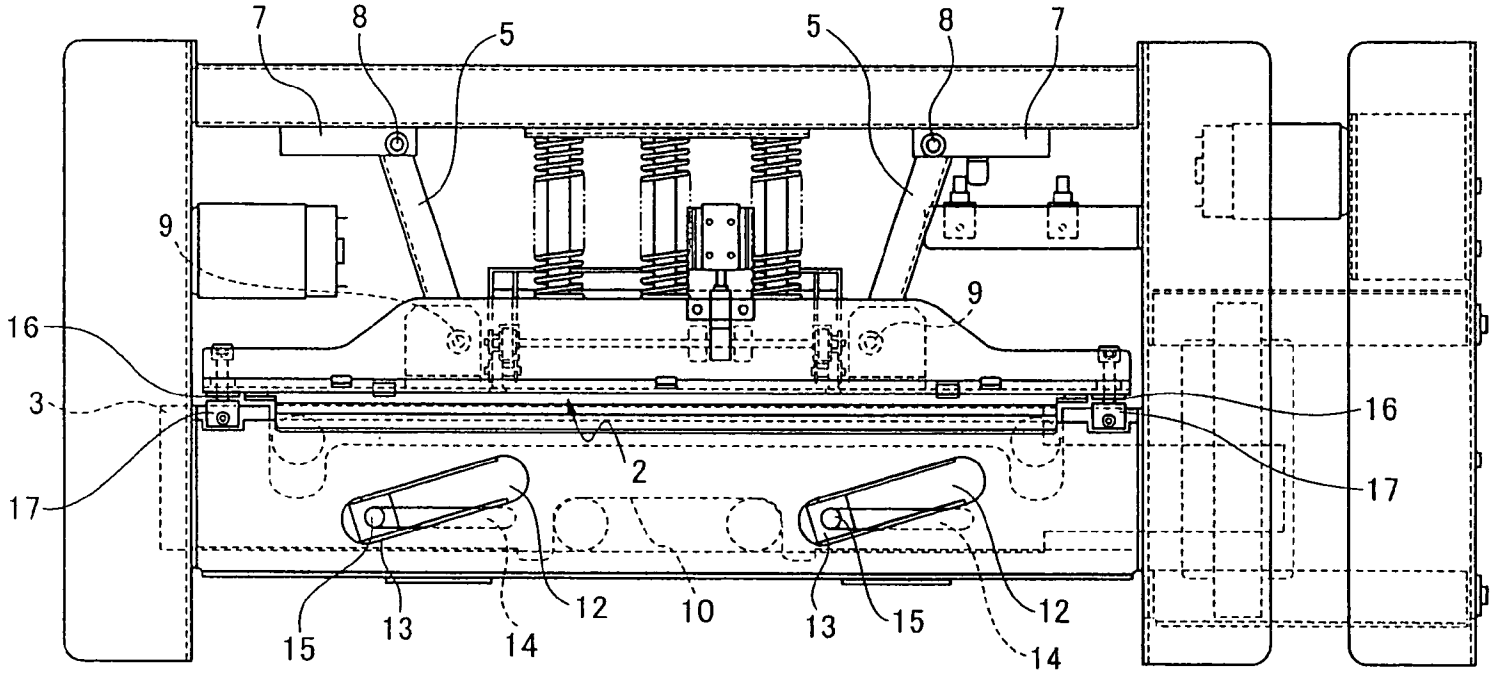
FIG. 1 shows a front view of an embodiment of the paper cutting device according to the present invention.

The paper cutting device of an embodiment according to the present invention is one that clamps paper stacked in layers with a paper retainer and cuts the paper with a cutter ascending diagonally from below. The cutter is pushed upward diagonally, and therefore the paper can be cut one sheet at a time from below, and thus the cut waste paper falls away naturally and does not attach to the blade edge of the cutter.

A cutting resistance of a cutting device that cuts multiple stacked sheets of a material to be cut (sheet bundles, stacked paper, metal foil, thin metal layer sheets), is known to fluctuate irregularly depending on changes in compression elasticity, which is the extent of deformation of the material to be cut brought about by the cutting object, and changes in frictional force. In driving this type of cutting device with a drive motor or the like, it is necessary to set a driving force of the driving motor according to a maximum cutting resistance as well as to set a rigidity of the cutting device itself based on the maximum cutting resistance.

The drawings show embodiments of a paper cutting device according to the present invention, having a paper retainer 2 that retains multiple sheets of paper 1 stacked in layers to prevent the multiple sheets of paper 1 stacked in layers from moving out of position and a cutter 3 for cutting the paper 1. The paper 1 stacked in layers is placed atop a table 4, the paper retainer 2 descends from above, and the paper 1 is tightly clamped by the paper retainer 2 so that the paper 1 does not move when it is cut.

The paper retainer 2 is comprised of a receiving part 18 and a paper retaining frame 20 that is a reversed "c" in cross-section, and contacts across the entire width of the paper, with the paper retaining frame 20 coupled to links 5, 5 mounted at equal distances from an intermediate shaft. The links 5, 5 are coupled via shafts 8, 8 to nuts 7, 7 that engage a screw 6. When the screw 6 turns, the interval between the nuts 7, 7 engaging the screw 6 increases and decreases, and as a result, the slant of the links 5, 5 coupled to the paper retaining frame 20 via the shafts 8, 8, 9, 9 changes.

In FIG. 1, when the interval between the nuts 7, 7 shrinks, the paper retainer 2 descends, pressing down on the stacked paper 1. Then, the paper retainer 2, because it is guided by a pair of vertical guides 19, 19 on both sides, ascends by the movement of the nuts 7, 7 attendant upon the rotation of the screw 6 without moving in a lateral direction. The screw 6 is rotationally driven by the motor, and by the interposition of a plurality of gears, rotational speed is decreased and the screw turns slowly. The paper retainer 2 is then urged downward by a spring force of a coil spring and the links 5, 5 rise, stretching the coil spring and causing the paper retainer 2 to descend.

In the present invention, because the paper retainer is one that combines a gear mechanism and a link mechanism, it can clamp the paper 1 with great force even with the use of, for example, a motor that delivers the equivalent of 25 W at a power supply of 24V DC. Then, by detecting the positions of the nuts 7, 7 the slant of the links 5, 5 can be ascertained, and as a result, the thickness of the paper 1 that is being retained by the paper retainer 2 can be known, and therefore it is possible to control the extent of movement of the cutter 3 precisely.

The cutter 3 is attached to the bottom of the above-described paper retainer 2 in a state in which the cutter 3 abuts a cutter stand 10, and slides engaged between two guides 11, 11. Moreover, the direction in which the cutter 3 slides is a vertically diagonal direction, with two guide grooves 12, 12 formed in the guides 11, 11 at a predetermined distance, the guide grooves 12, 12 also slanted in a diagonal direction.

Sliders 13, 13 are mounted on shaft pins that pass through the cutter 3 and the cutter stand 10, and the sliders 13, 13 engage the guide grooves 12, 12. When the sliders 13, 13 move along the guide grooves 12, 12, the cutter 3 slides in the diagonal direction. However, because the sliders 13, 13 engage and move along the guide grooves 12, 12 formed in parallel, the cutter 3 always remains horizontal as it moves. When the sliders 13, 13 are at the left end of the slanted guide grooves 12, 12 the cutter 3 is lowered, but the cutter 3 ascends as the sliders 13, 13 slide and move to the right.

At the same time, horizontally extending slots 14, 14 are provided in the cutter stand 10 that the cutter 3 abuts. Shaft pins 15, 15 engage the slots 14, 14. Therefore, when the sliders 13, 13 move diagonally along the guide grooves 12, 12, the cutter 3 moves diagonally along the guide grooves 12, 12 but the cutter stand 10 ascends and descends vertically.

There is no limitation on the specific means used to raise and lower the cutter 3 and the cutter stand 10. Thus, for example, a screw may be mounted horizontally on the bottom of the cutter 3, the screw may be rotatably driven through a plurality of gears by a motor, and a nut may engage the screw and move together with the rotation of the screw. The movement of the nut attendant upon the rotation of the screw is then transmitted to the sliders 13, 13.

Therefore, the cutter 3 is pushed diagonally upward along the guide grooves 12, 12 and the paper 1 that is being clamped by the paper retainer 2 is cut from the bottom one sheet at a time. The paper 1 cuttings, because the paper is cut one sheet at a time, fall away without sticking to the surface of the edge of the blade, and therefore the waste paper does not attach to the edge of the blade. At this point, because the cutter 3 ascends and at the same time moves horizontally as well when cutting the paper 1, the paper 1 is tightly clamped by the paper retainer 2 via the links 5, 5 so that the clamped paper 1 does not move out of position.

However, the sharpness of the cutter is optimal when the cutting resistance between the cutter and the paper is small. In cutting, there is "push cutting", in which the cutter is pushed in a direction perpendicular to the wedge of the edge of the blade, and "pull cutting", in which the cutter is pushed while moving parallel to the wedge of the edge of the blade. The present invention adopts a method that favors the latter "pull cutting". However, from a cutter front end angle (wedge angle) $\gamma$, a velocity V at which it is pushed in a direction perpendicular to the wedge of the edge of the blade (push velocity), and a velocity v at which the cutter moves parallel to the wedge of the edge of the blade (horizontal velocity), an apparent cutter front end angle (effective wedge angle) $\beta$ is expressed by the following equation:

$$\tan\beta = V/(V^2+v^2)^{1/2}\cdot\tan\gamma$$

As can be seen from this equation, the cutting resistance changes depending on the paper quality and the apparent front end angle (effective wedge angle) $\beta$ of the cutter, and there exists an optimal wedge angle $\beta$ suited to the paper quality. The paper cutting device of the present invention takes into account the above-described equation, and based on such limiting condition as the actual dimensions, cutting time, and so forth attendant upon installation in office equipment and the like, is equipped with guide grooves to adjust to the optimal push velocity V and the optimal horizontal velocity v as well as sliders that engage these guide grooves.

The paper cutting device of the present invention cuts the clamped paper 1 by raising the cutter 3, so that the edge of the blade of the cutter 3 bites slightly into the blade receiving surface of the receiving part of the paper retainer 2. Moreover, stoppers 16, 16 are mounted on both sides of the paper retainer 2 so as to prevent incomplete cutting of the paper 1 by the failure of the edge of the blade of the cutter 3 to reach the blade receiving surface, or conversely, to prevent the edge of the blade of the cutter 3 from biting too deeply into the blade receiving surface.

The stoppers 16, 16 are of screw construction, and therefore their front end positions are adjustable. Stopper stands 17, 17 are installed on the cutter stand 10 that the cutter 3 abuts. When the cutter 3 ascends, the stopper stands 17, 17 contact the stoppers 16, 16 installed on the paper retainer 2 and prevent the cutter 3 from rising. The cutter 3 ascends diagonally but the cutter stand 10 ascends vertically and the stopper stands 17, 17 contact the stoppers 16, 16.

When the cutter 3 ascends and the stopper stands 17, 17, contact the stoppers 16, 16, a load above the rating of the motor is exerted on the motor for raising the cutter 3. The motor is controlled so that when the load exceeds the motor rating, the rotation of the motor is stopped, thus preventing the edge of the blade of the cutter 3 from biting too deeply into the receiving part of the paper retainer 2 without at the same time leaving any of the paper 1 uncut.

Thus, as described above, the edge of the blade of the cutter 3 bites into the blade receiving surface of the receiving part in order to cut the paper 1, and as the bite groove in the blade receiving surface grows larger with the repetition of this action it gradually becomes impossible to cut the paper 1 correctly. As a result, in the present invention, the receiving part 18 is a movable one. Specifically, the cutter 3 is configured to slide a certain pitch when the cutter 3 reaches a predetermined stroke count (for example, 500 to 600).

Figure 3A:
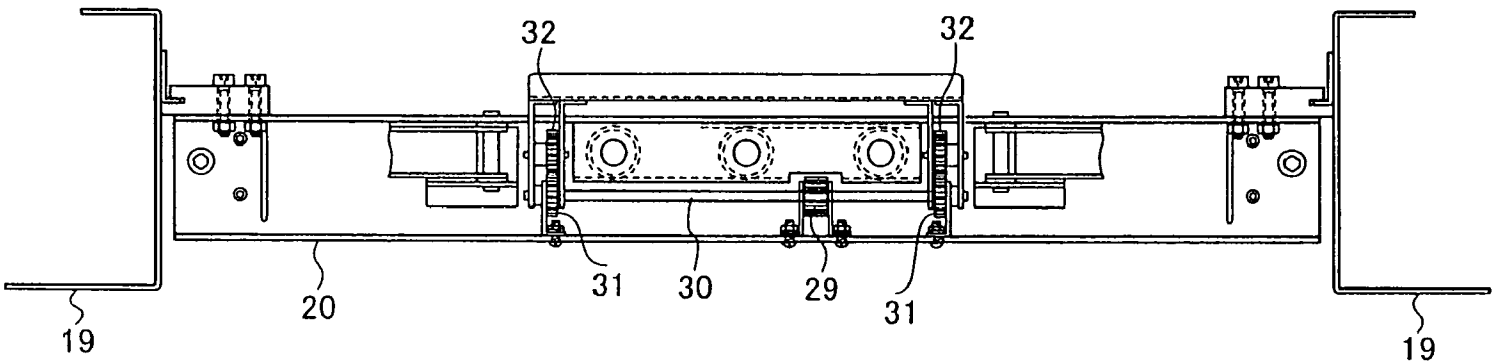
FIG. 3A shows a plan view of a drive device of a receiving part of the embodiment.
Figure 3B:
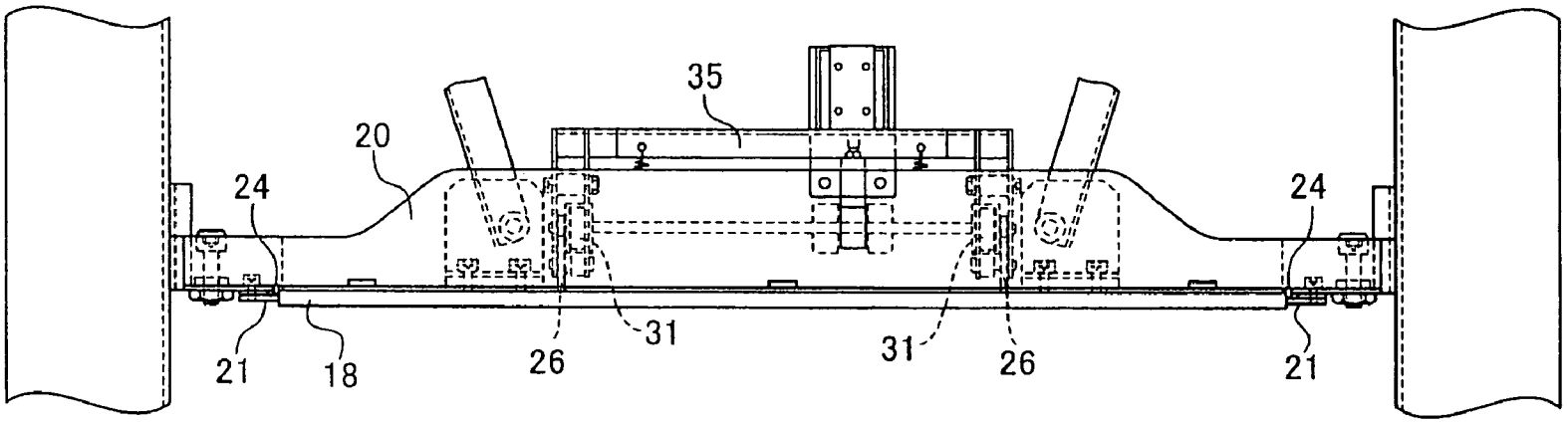
FIG. 3B shows a front view of the drive device of the receiving part of the embodiment.

The paper retaining frame 20 has a shape in cross-section like that of a reversed letter "c" but with the opening facing up, and, as shown in FIG. 3A and FIG. 3B, ascends and descends guided by vertical guides 19, 19 on both sides thereof, with the receiving part 18 mounted on a bottom surface of the paper retaining frame 20. Supports 21, 21 are screwed in place on both sides of the bottom surface, such that both ends of the movable receiving part 18 are slidably supported by the supports 21, 21.

Figure 4A:
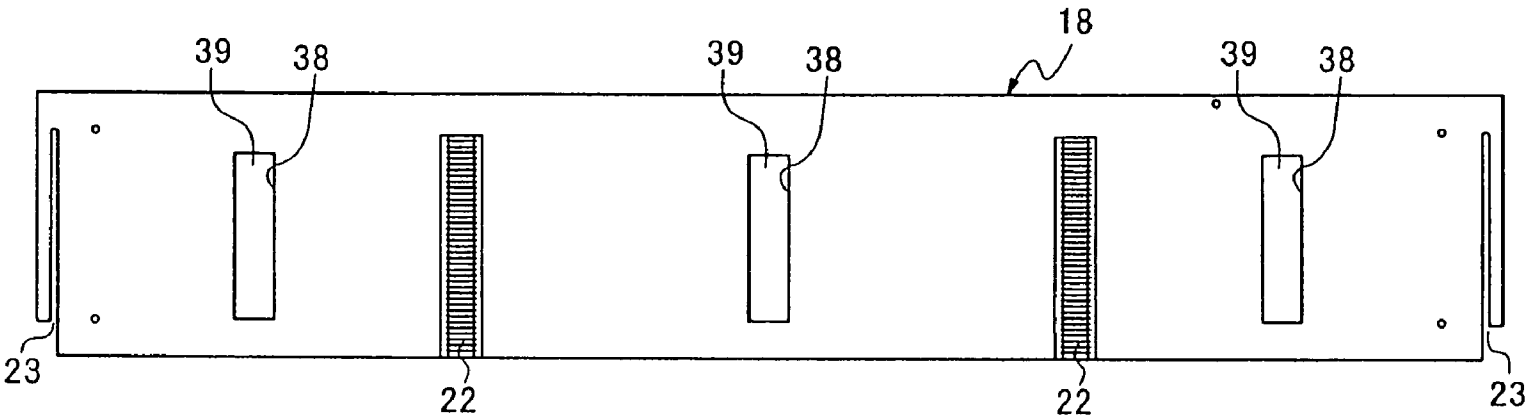
FIG. 4A shows a plan view of the receiving part provided with a first example of a slip prevention means.
Figure 4B:
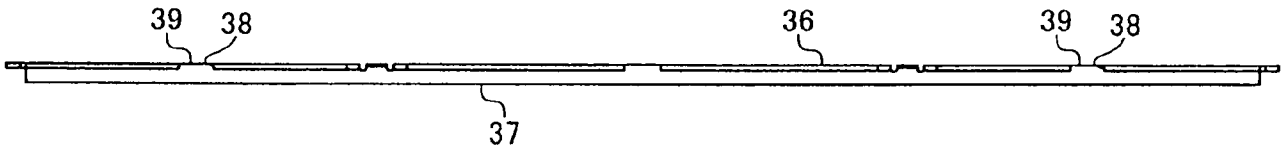
FIG. 4B shows a front view of the receiving part provided with the first example of the slip prevention means.
Figure 4C:
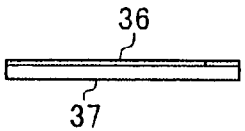
FIG. 4C shows a side view of the receiving part provided with the first example of the slip prevention means.
Figure 5:
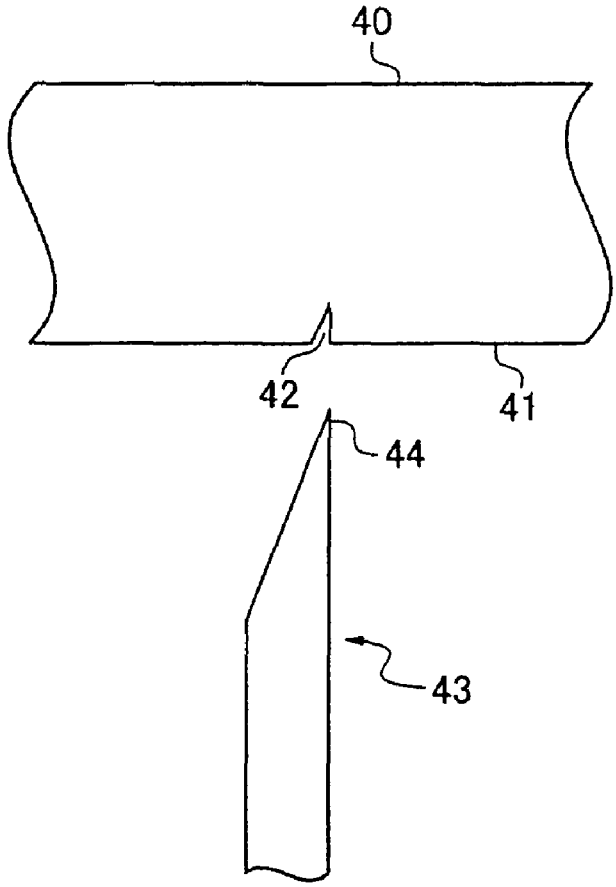
FIG. 5 shows a partial enlarged view of a cutter blade edge and the receiving part having a bite-in groove formed by the cutter blade edge.
Figure 6A:
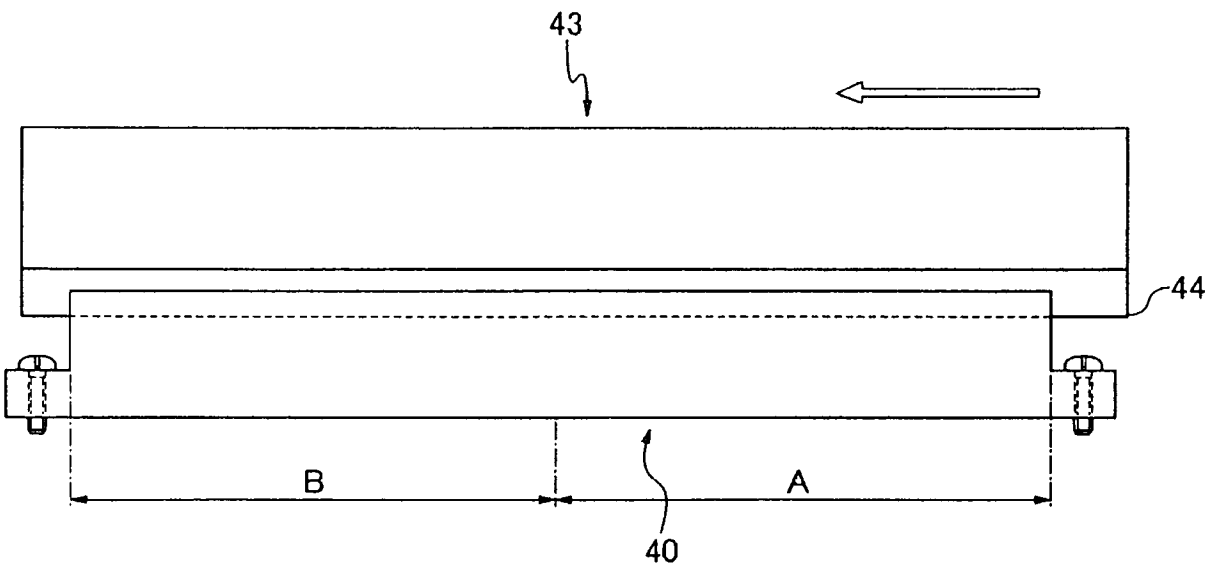
FIG. 6A shows a front view illustrating extension deformation of the receiving part when the cutter blade edge slides while biting into a blade receiving surface.
Figure 6B:
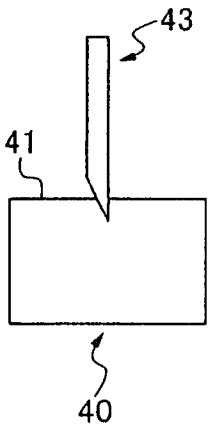
FIG. 6B shows a side view of a state in which the cutter blade edge slides while biting into the blade receiving surface.

FIGS. 4A to 4C show the movable receiving part 18, but with receiving part racks 22, 22 formed a predetermined interval apart on a top surface of the movable receiving part 18 and with guide grooves 23, 23 provided on the outside of the receiving part racks 22, 22. Then, guide flanges 24, 24 installed on the bottom surface of the paper retaining frame 20 engage the guide grooves 23, 23, pinion gears 26, 26 engage the receiving part racks 22, 22, and the rotation of the pinion gears 26, 26 enables the movable receiving part 18 to slide along the guide flanges 24, 24.

Figure 2:
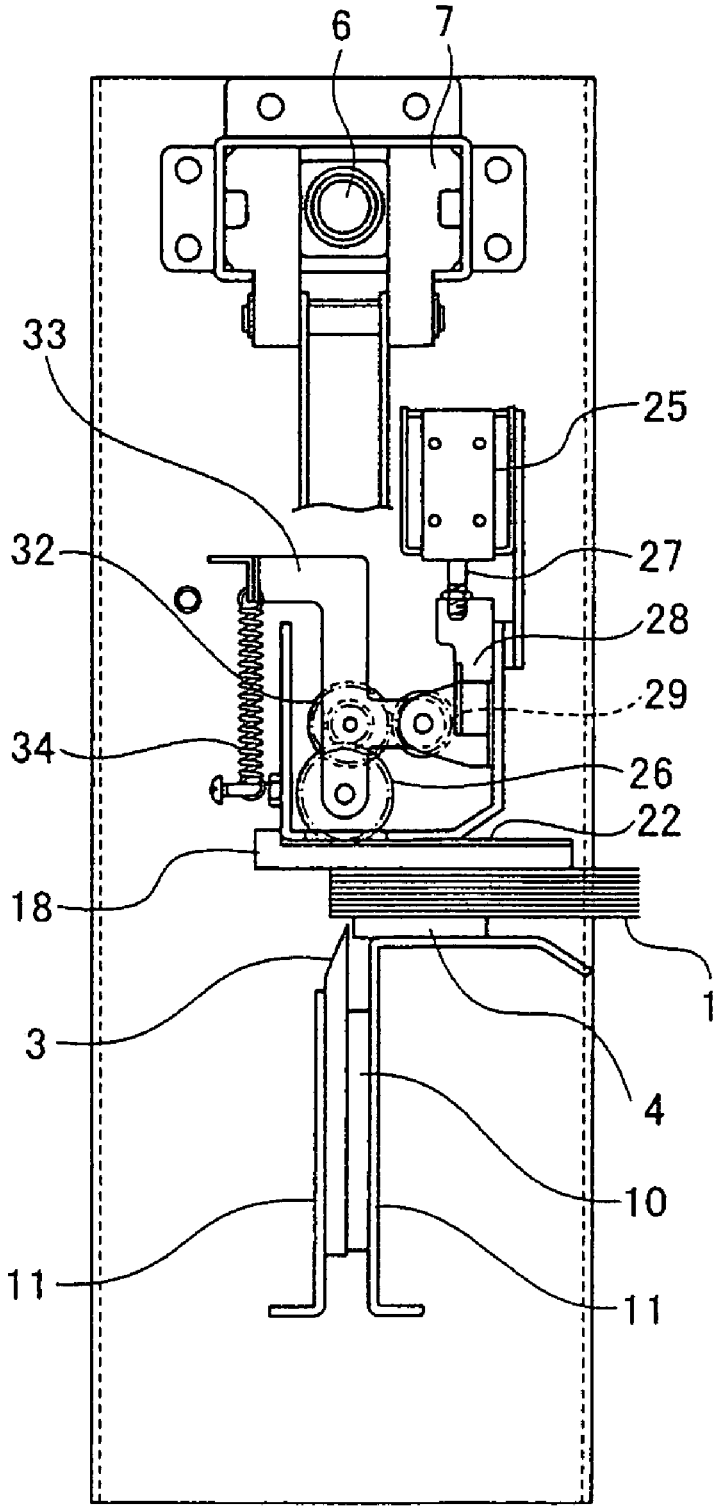
FIG. 2 shows a vertical sectional view of the same embodiment of the paper cutting device according to the present invention.

In the present embodiment, as shown in FIG. 2, the pinion gear 26 is rotated by the action of a solenoid 25. A rack 28 is coupled to a rod 27 that is the movable core of the solenoid 25, and this rack 28 engages a one-way clutch gear 29. Therefore, although the one-way clutch gear 29 rotates when the solenoid 25 operates and the rack 28 descends, when the rack 28 ascends the one-way clutch gear 29 does not rotate.

The one-way clutch gear 29 is installed on a shaft 30, the two ends of the shaft 30 are supported by shaft bearings of a support frame 35 mounted on the paper retaining frame 20, and gears 31, 31 are installed on both ends of the shaft 30. Then, the gears 31, 31 engage gears 32, 32, and further, the gears 32, 32 engage the pinion gears 26, 26. However, the gears 31, 32 and the pinion gear 26 are mounted on a bracket 33, and this bracket 33 is rockingly supported coaxially with the gears 31, 31.

Therefore, the operation of the solenoid 25 causes the pinion gear 26 to rotate via the rack 28, the one-way clutch gear 29, the gear 31, and the gear 32. Then, the rotation of the pinion gear 26 causes the receiving part rack 22 to move and the movable receiving part 18 slides a certain pitch amount.

At this point, the bracket 33 is rockingly supported coaxially with the gears 31, 31 and is pressed downward by the spring force of a coil spring 34. Specifically, the pinion gear 26 is urged by the spring force so as to correctly engage the receiving part rack 22 of the movable receiving part 18 and not slip when driven. The two ends of the coil spring 34 are coupled to a front end of the bracket 33 and to the paper retaining frame 20.

Then, when replacing the movable receiving part 18, the spring 34 is stretched and the bracket 33 is lifted up. In other words, by rocking about the shaft 30 of the gear 31, the bracket 33 is lifted, and in this state the movable receiving part 18 can now be replaced.

Thus, as described above, although the movable receiving part 18 is constructed so as to move slightly each time with the rotation of the pinion gear 26, it can be fixedly mounted on the paper retaining frame 20 when cutting the paper 1. In the embodiment shown in FIG. 3A and FIG. 3B, the movable receiving part 18 is supported by the support 21 on the bottom surface of the paper retaining frame 20. However, the movable receiving part 18 must move in conjunction with the rotation of the pinion gear 26, and as a result the support structure for the movable receiving part 18 is not a structure that always fully clamps the movable receiving part 18 to the support 21.

It should be noted that the movable receiving part 18 as shown in FIG. 4A and FIG. 4C is composed of a metal base plate 36 and a resin receiving plate 37, with the guide grooves 23, 23 provided on both sides of the base plate 36. Then, rectangular displacement stop concavities 38, 38, 38 are formed in the base plate 36 at three locations consisting of both sides and the center, while in the receiving plate 37 rectangular displacement stop convexities 39, 39, 39 are provided on both sides and in the center thereof. Then, when the receiving plate 37 is stacked atop the base plate 36, the displacement stop convexities 39, 39, 39 engage the displacement stop concavities 38, 38, 38 and the two plates are bolted together and fixed in place at both side ends.

Thus, as described above, the receiving part 18 of the present invention joins together a metal base plate 36 of high elastic modulus and a resin receiving plate 37, and also engages the displacement stop convexities 39, 39, 39 with the displacement stop concavities 38, 38, 38 in order to prevent positional displacement in a long direction. Therefore, the receiving plate 37 is fixed on the base plate 36 at the three locations at which the displacement stop convexities 39, 39, 39 engage the displacement stop concavities 38, 38, 38, and extension/contraction deformation of the receiving plate 37 is carried out between the displacement stop convexities. Positional displacement does appear at the center because the center between the displacement stop convexities 39, 39, 39 is the boundary between contraction deformation and extension deformation, but the extent of that positional displacement is proportional to the square of the distance between displacement stop convexities.

Figure 7A:
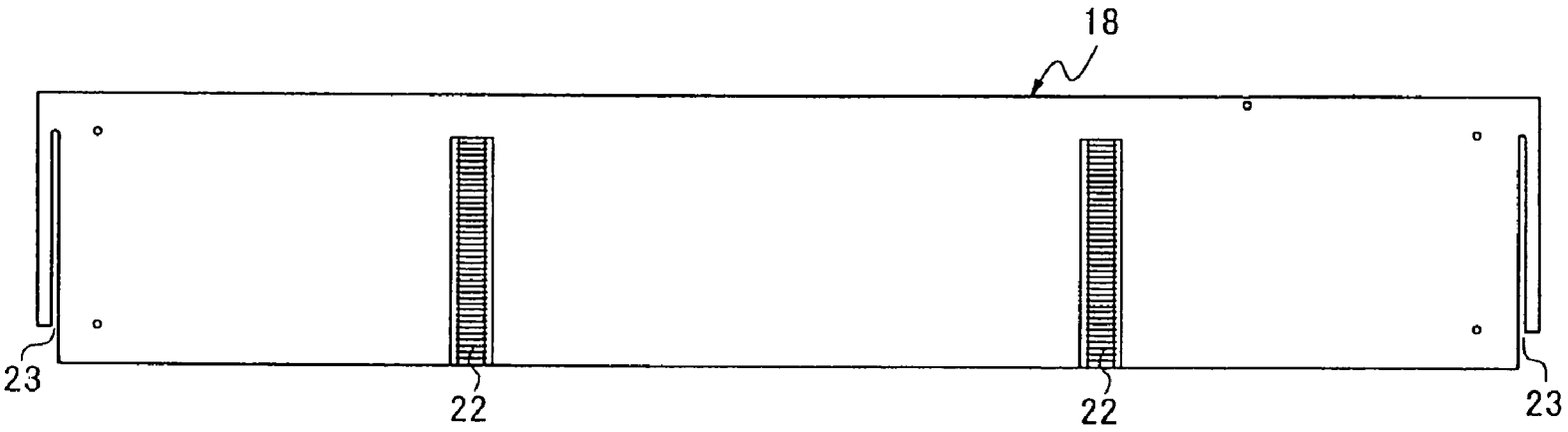
FIG. 7A shows a plan view of the receiving part provided with a second example of a slip prevention means.
Figure 7B:
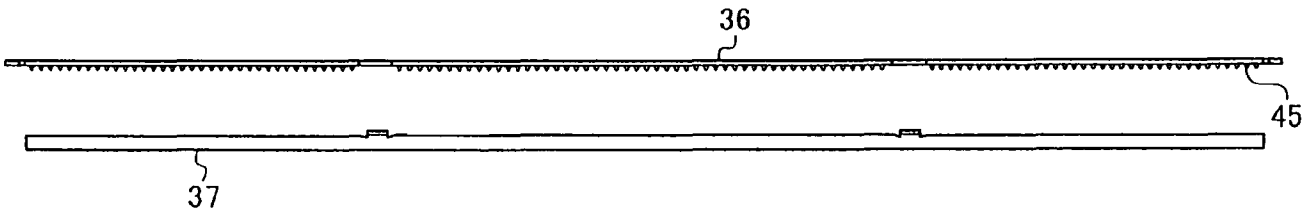
FIG. 7B shows a plan view of the receiving part provided with the second example of the slip prevention means prior to a joining of a base plate and a receiving plate.
Figure 7C:
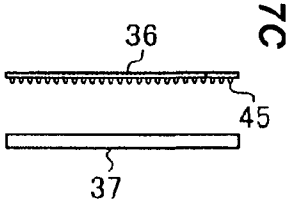
FIG. 7C shows a side view of the receiving part provided with the second example of the slip prevention means prior to the joining of the base plate and the receiving plate.

However, because the displacement stop concavities 38, 38, 38, are provided at three locations on the base plate 36, and in correspondence thereto the displacement stop convexities 39, 39, 39 are provided at three locations on the receiving plate 37, the positional displacement can be kept to a minimum. Consequently, since the distance between displacement stop convexities decreases when the number of displacement stop concavities 38, 38 . . . and the number of displacement stop convexities 39, 39 . . . is increased, the extent of the positional displacement at the center can be further reduced. Moreover, by forming innumerable fine spike-like projections 45 on the junction surface of the base plate instead of the displacement stop convexities 39 as shown in FIGS. 7A to 7C, and in particular as shown in FIG. 7B and FIG. 7C showing a state prior to the joining of the base plate 36 and the receiving plate 37, and by making the spike-like projections 45 bite into the junction surface of the resin receiving plate 37, the base plate 36 and the receiving plate 37 can be made to adhere to each other as a single integrated unit over all junction surfaces, thereby eliminating the occurrence of singular deformation in only the receiving plate 37.

If the material of the receiving plate 37 is polypropylene (PP), its elastic modulus is from $10^3$ to $10^4$ kg/cm$^2$, and it extends easily in response to tension. By contrast, the elastic modulus of a steel base plate 36 is approximately $2.1\times10^6$ kg/cm$^2$, and it does not extend easily in response to tension. The present invention uses the composite structure shown in FIGS. 4A to 4C, or the composite structure shown in FIGS. 7A to 7C, enabling a receiving part that does not extend easily to be constructed.

Thus, as described above, the cutting device according to the present invention is particularly useful in a paper cutting device that disposes a cutter below the paper retainer, provides a receiving part that receives a cutter blade on the paper retainer that presses on the paper from above, and cuts the paper with the ascending cutter. However, it can also be applied to any cutting device, such as one for cutting sheet bundles, stacked paper, metal foil, thin metal layer sheets, or the like, that cuts by moving the wedge of the edge of the blade of the cutter and the blade receiving surface of the receiving part in a parallel direction.

The invention claimed is:

1. A paper cutting device for cutting multiple sheets of paper stacked in layers on a table, comprising:

a pair of vertically extending guides;

a paper retainer movably mounted to the vertically extending guides to move vertically along the guides to retain paper from above; and a cutter arranged to move vertically diagonally, ascend from below diagonally, and cut the paper;

wherein the paper retainer comprises a receiving part arranged to contact an uppermost sheet of the multiple sheets of paper and to receive a cutter blade, and a paper retaining frame engaged with the vertically extending guides, said paper retaining frame having a bottom surface;

wherein the receiving part is movably mounted onto the bottom surface of the paper retaining frame such that said receiving part is movable relative to said paper retaining frame so that the receiving part can be slidably shifted horizontally with respect to said paper retaining frame;

wherein a solenoid, at least one pinion gear, and a transmission to cause rotation of said at least one pinion gear upon activation of said solenoid are mounted to said paper retaining frame, and said receiving part includes at least one rack engaged with said at least one pinion gear such that, upon activation of said solenoid, said receiving part is slidably shifted horizontally relative to said paper retaining frame; and wherein the receiving part comprises a metal base plate having a top surface and a bottom surface, a resin receiving plate having a top surface and a bottom surface and being joined to the metal base plate such that the top surface of the resin receiving plate faces the bottom surface of the metal base plate, and mutually engageable slip prevention parts respectively provided at the bottom surface of the metal base plate and the top surface of the resin receiving plate to prevent mutual slippage of the metal base plate relative to the resin receiving plate.

2. The paper cutting device according to claim 1, further comprising:

a motor to drive the paper retainer;

a screw that is rotated by the motor;

a nut that engages the screw;

a link that couples the nut to the paper retainer;

a pair of guides, each having a guide groove that extends in a diagonal direction, the pair of guides holding between them the cutter so that the cutter slides freely within the guide grooves;

a slider that extends in a perpendicular direction with respect to a surface of the cutter and engages the guide grooves; and a mechanism that moves the receiving part a certain pitch when a cutter stroke count reaches a predetermined number, said mechanism comprising said solenoid, said at least one pinion gear and said transmission.

3. The paper cutting device according to claim 1, wherein, as the slip prevention parts, a displacement stop convexity is provided on one of the bottom surface of the metal base plate and the top surface of the resin receiving plate, and a displacement stop concavity is provided on the other of the bottom surface of the metal base plate and the top surface of the resin receiving plate, the displacement stop convexity engaging the displacement stop concavity.

4. The paper cutting device according to claim 1, wherein, as the slip prevention parts, plural fine spike-like projections are formed on one of the bottom surface of the metal base plate and the top surface of the resin receiving plate, and the metal base plate and the resin receiving plate are joined such that the spike-like projections are bitten into the other of the bottom surface of the metal base plate and the top surface of the resin receiving plate.

5. The paper cutting device according to claim 2, wherein, as the slip prevention parts, a displacement stop convexity is provided on one of the bottom surface of the metal base plate and the top surface of the resin receiving plate, and a displacement stop concavity is provided on the other of the bottom surface of the metal base plate and the top surface of the resin receiving plate, the displacement stop convexity engaging the displacement stop concavity.

6. The paper cutting device according to claim 2, wherein, as the slip prevention parts, plural fine spike-like projections are formed on one of the bottom surface of the metal base plate and the top surface of the resin receiving plate, and the metal base plate and the resin receiving plate are joined such that the spike-like projections are bitten into the other of the bottom surface of the metal base plate and the top surface of the resin receiving plate.

7. The paper cutting device according to claim 1, wherein said receiving part is movably mounted to said paper retaining frame by a groove and flange arrangement.

8. The paper cutting device according to claim 7, wherein said groove and flange arrangement includes at least one groove formed in said receiving part, and at least one flange provided on the bottom surface of the paper retaining frame and respectively slidably engaged in said at least one groove of said receiving part.

9. The paper cutting device according to claim 8, wherein said at least one groove comprises a pair of grooves formed in opposing outer ends of said receiving part, and said at least one flange comprises a pair of flanges installed on the bottom surface of said paper retaining frame and respectively slidably engaged in said grooves of said receiving part.

10. The paper cutting device according to claim 9, further comprising a pair of links having first ends pivotally connected to said paper retaining frame and second ends to be pivotally connected to nuts engaged with a motor screw.

11. The paper cutting device according to claim 8, further comprising a pair of links having first ends pivotally connected to said paper retaining frame and second ends to be pivotally connected to nuts engaged with a motor screw.

12. The paper cutting device according to claim 7, further comprising a pair of links having first ends pivotally connected to said paper retaining frame and second ends to be pivotally connected to nuts engaged with a motor screw.

13. The paper cutting device according to claim 1, further comprising a pair of links having first ends pivotally connected to said paper retaining frame and second ends to be pivotally connected to nuts engaged with a motor screw.

14. The paper cutting device according to claim 1, wherein said transmission comprises a second rack gear engaged between said second rack and said at least one pinion gear.

* * * * *